US009910395B2

(12) United States Patent
Cousoulis et al.

(10) Patent No.: US 9,910,395 B2
(45) Date of Patent: Mar. 6, 2018

(54) SYSTEMS AND METHODS FOR CONTROLLING TONER DEVELOPMENT IN AN IMAGE FORMING DEVICE

(71) Applicant: Lexmark International, Inc., Lexington, KY (US)

(72) Inventors: Marc Cousoulis, Lexington, KY (US); Courtney Harrison Soale, Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 6 days.

(21) Appl. No.: 15/213,494

(22) Filed: Jul. 19, 2016

(65) Prior Publication Data

US 2018/0024487 A1 Jan. 25, 2018

(51) Int. Cl.
*G03G 15/06* (2006.01)
*G03G 15/00* (2006.01)

(52) U.S. Cl.
CPC ..... *G03G 15/556* (2013.01); *G03G 15/065* (2013.01)

(58) Field of Classification Search
None
See application file for complete search history.

(56) References Cited

U.S. PATENT DOCUMENTS 5,805,956 A * 9/1998 Kawai ..... G03G 15/0266 399/46
2002/0037184 A1* 3/2002 Nakamura ..... G03G 15/0818 399/286
2004/0131370 A1* 7/2004 Yamauchi ..... G03G 15/50 399/24
2006/0171729 A1* 8/2006 Okada ..... G03G 15/0121 399/55
2006/0280514 A1* 12/2006 Yokogawa ..... G03G 15/065 399/55
2007/0077078 A1* 4/2007 Karasawa ..... G03G 15/065 399/38

* cited by examiner

*Primary Examiner* — Clayton E LaBalle
*Assistant Examiner* — Victor Verbitsky

(57) ABSTRACT

A method of controlling toner development during a life of an imaging unit in an image forming device by determining whether an end of life of the imaging unit has been reached and upon a positive determination, performing at least one of incrementally lowering a target toner mass to be measured by a toner patch sensor and incrementally reducing the magnitude of voltage biases applied to at least one of the magnetic roll and the charging roll of the imaging forming device. Performing the acts of incrementally lowering and reducing are repeated until the imaging unit is replaced. The method reduces the risk of damage to the image forming device due to carrier bead development while allowing for printing to occur.

8 Claims, 7 Drawing Sheets

SYSTEMS AND METHODS FOR CONTROLLING TONER DEVELOPMENT IN AN IMAGE FORMING DEVICE

CROSS REFERENCES TO RELATED APPLICATIONS

None.

BACKGROUND

1. Field of the Disclosure

The present disclosure relates generally to controlling toner development in an image forming device and more particularly to methods of automatically controlling toner development by reducing toner density during a life of an imaging unit in an image forming device to reduce any risk of carrier bead development.

2. Description of the Related Art

An imaging unit in electrophotographic devices (i.e., mono or color laser printers) includes a photoconductor portion and a toner development portion. When an electrophotographic device performs a print operation, a photoconductor is initially charged to a uniform potential. Appropriate areas of the photoconductor are then discharged by a laser or light emitting diode system to create a latent electrostatic image thereon. This discharged portion of the photoconductor is presented to the toner development portion and toner is developed to either the discharged portion or charged portion of the photoconductor. The photoconductor is then rotated to where the toner developed to the photoconductor is transferred to an image medium which may be a sheet of media or an intermediate transfer member (for subsequent transfer to a media sheet).

In a dual component toner development system, toner particles are mixed with particulate additives which include magnetic carrier beads. Magnetic carrier beads help in transporting the toner particles to the discharged portion of the photoconductor. However, over the life of the imaging unit, changes to the toner, carrier beads, and the photoconductor all have an impact on toner development.

In particular, it will be understood that as photoconductors age in typical dual component development systems, a polymeric layer of each photoconductor wears away, thus increasing a surface charge thereof. This increase in surface charge of the photoconductor translates to an increase in a likelihood of the magnetic carrier beads also developing with the toner particles onto the discharged portions of the photoconductor. In addition to the wearing of the polymeric layer of the photoconductor, a polymeric coating of the carrier heads wears out overtime, resulting in a change in conductivity thereof andior the ability to charge the toner. Other extra particulate additives from the toner particles can also accumulate on the carrier bead surface, impacting the ability for the toner to reach a charging site on the carrier beads. These aforementioned changes over time affect the amount of toner being developed onto the photoconductor surface. When the imaging unit reaches a rated point in its life in which the carrier beads have accumulated wear or have become covered with the above-mentioned extra particulate additives, or the polymeric layer of the photoconductor has become worn, the amount of carrier heads unintentionally developed to the photoconductor surface may increase as the developed toner mass increases.

Carrier bead development on the photoconductor occurring with toner development is undesirable and is thought to eventually cause damage to the imaging unit. Typically, a life of the imaging unit is rated at a point where a level of carrier bead development will not be detrimental to the system. Continuing to use the imaging unit beyond this point will increase the risk of carrier beads damaging the various components of the image forming device, such as the intermediate transfer belt and fuser.

SUMMARY

Example embodiments overcome shortcomings of existing toner development systems and satisfy a need for methods of reducing risk of damage to an image forming device or to any components thereof (i.e., an imaging unit) brought about by carrier bead development as the imaging unit ages. Disclosed herein is an image forming device including a controller and an imaging unit having a photoconductive member and a magnetic roll between which the toner development occurs. The image forming device further includes an optical sensor for measuring absolute reflectivity on a surface of the photoconductor, an intermediate transfer member or a media sheet.

In one example embodiment, upon a positive determination by the controller that at least a portion of the imaging unit has reached a predetermined end of life condition, the controller lowers a target toner mass amount to be measured by the optical sensor at a predetermined location in the image forming device. As a result of the lowering, the controller determines a corresponding development bias level needed for the lowered target toner mass amount. For every predetermined amount of print operations performed, the controller determines whether a lowest development bias level has been reached based on the lowered target toner mass. Until controller determines that the lowest development bias level has been reached, lowering the target toner mass may be repeated by the controller for every predetermined amount of print operations performed.

In an alternative example embodiment, upon a positive determination by the controller that at least a portion of the imaging unit has reached a predetermined end of life condition, the controller incrementally reduces a magnitude of a voltage bias applied to one or both of the magnetic roll and the charging roll so as to achieve a lowered development bias. Reducing voltage biases of at least one of the magnetic roll and the charging roll may be repeated for every predetermined amount of print operations performed until the controller determines that the lowest development bias level has been reached.

In both of the embodiments, when the controller determines that the lowest development bias level has been reached, the controller maintains the lowest development bias level until the imaging unit is replaced.

By lowering the target toner mass and the development biases, a print operation may still be performed at a lower print quality and with a substantially reduced risk of component damage due to carrier bead development.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

Figure 1:
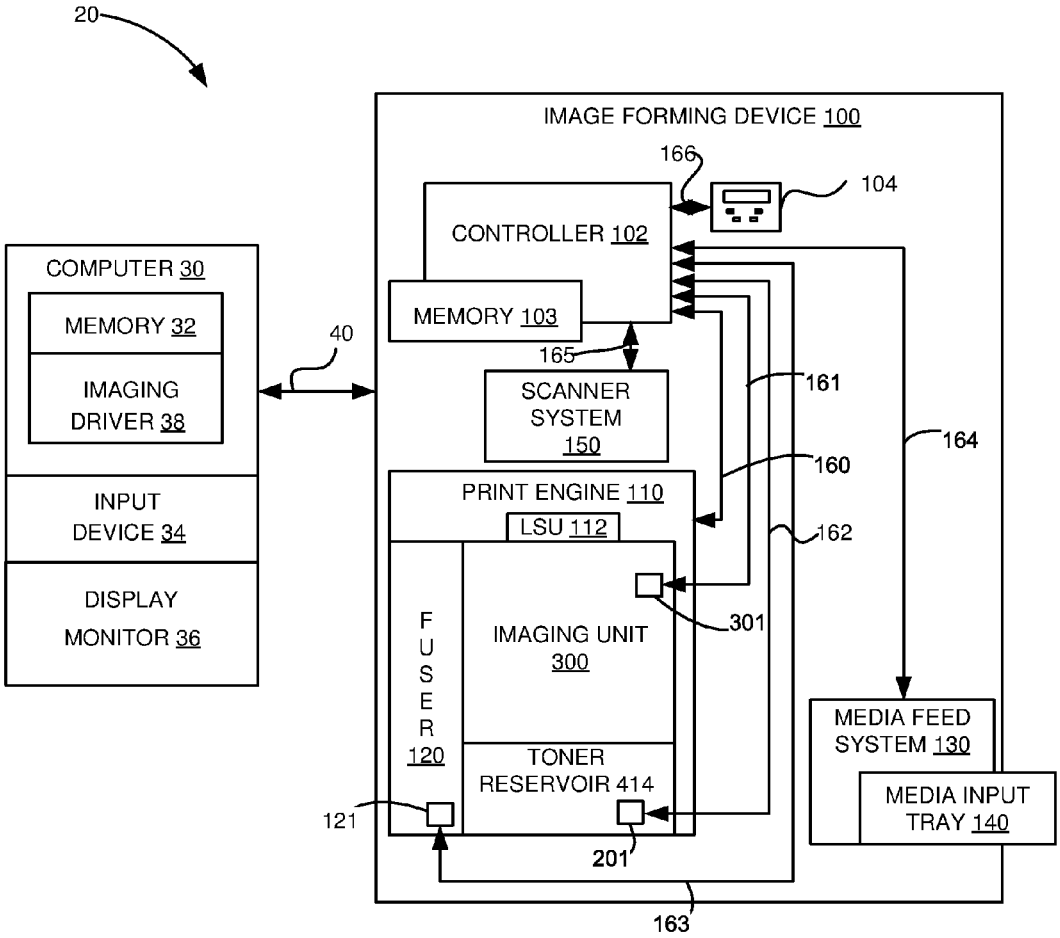
FIG. 1 is a schematic diagram of an image forming device according to an example embodiment.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and positionings. In addition, the terms "connected" and "coupled" and variations thereof are not restricted to physical or mechanical connections or couplings.

Spatially relative terms such as "top", "bottom", "front", "back" and "side", and the like, are used for ease of description to explain the positioning of one element relative to a second element. Terms such as "first", "second", and the like, are used to describe various elements, regions, sections, etc. and are not intended to be limiting. Further, the terms "a" and "an" herein do not denote a limitation of quantity, but rather denote the presence of at least one of the referenced item.

Furthermore, and as described in subsequent paragraphs, the specific configurations illustrated in the drawings are intended to exemplify embodiments of the disclosure and that other alternative configurations are possible.

Reference will now be made in detail to the example embodiments, as illustrated in the accompanying drawings. Whenever possible, the same reference numerals will be used throughout the drawings to refer to the same or like parts.

Referring now to the drawings and more particularly to FIG. 1, there is shown a block diagram depiction of an imaging system 20 according to one example embodiment. Imaging system 20 includes an image forming device 100 and a computer 30. Image forming device 100 communicates with computer 30 via a communications link 40. As used herein, the term "communications link" generally refers to any structure that facilitates electronic communication between multiple components and may operate using wired or wireless technology and may include communications over the Internet.

In the example embodiment shown in FIG. 1, image forming device 100 is a multifunction machine that includes a controller 102, a print engine 110, a laser scan unit (LSU) 112, one or more toner bottles or cartridges 200, one or more imaging units 300, a fuser 120, a user interface 104, a media feed system 130 and media input tray 140 and a scanner system 150. Image forming device 100 may communicate with computer 30 via a standard communication protocol, such as, for example, universal serial bus, Ethernet or IEEE 802.xx. Image forming device 100 may be, for example, an electrophotographic printer/copier including an integrated scanner system 150 or a standalone electrophotographic printer.

Controller 102 includes a processor unit and associated memory 103 and may be formed as one or more Application Specific Integrated Circuits. Memory 103 may be any volatile or non-volatile memory or combination thereof such as, for example, random access memory (RAM), read only memory (ROM), flash memory and/or non-volatile RAM (NVRAM). Alternatively, memory 103 may be in the form of a separate electronic memory (e.g., RAM, ROM, and/or NVRAM), a hard drive, a CD or DVD drive, or any memory device convenient for use with controller 102. Controller 102 may be, for example, a combined printer and scanner controller.

In the example embodiment illustrated, controller 102. communicates with print engine 110 via a communications link 160. Controller 102 communicates with imaging unit(s) 300 and processing circuitry 301 on each imaging unit 300 via communications link(s) 161. Controller 102 communicates with toner cartridge(s) 200 and processing circuitry 201 on each toner cartridge 200 via communications link(s) 162. Controller 102 communicates with fuser 120 and processing circuitry 121 thereon via a communications link 163. Controller 102 communicates with media feed system 130 via a communications link 164. Controller 102 communicates with scanner system 150 via a communications link 165. User interface 104 is communicatively coupled to controller 102 via a communications link 166. Processing circuitries 121, 201, and 301 may each include a processor and associated memory such as RAM, ROM, and/or NVRAM and may provide authentication functions, safety and operational interlocks, operating parameters and usage information related to fuser 120, toner cartridge(s) 200 and imaging units 300, respectively. Controller 102 processes print and scan data and operates print engine 110 during printing and scanner system 150 during scanning.

Computer 30, which is optional, may be, for example, a personal computer, including memory 32, such as RAM, ROM, and/NVRAM, an input device 34, such as a keyboard and/or a mouse, and a display monitor 36. Computer 30 also includes a processor, input/output (I/O) interfaces, and may include at least one mass data storage device, such as a hard drive, a CD-ROM and/or a DVD unit (not shown). Computer 30 may also be a device capable of communicating with image forming device 100 other than a personal computer such as, for example, a tablet computer, a smartphone, or other electronic device.

In the example embodiment illustrated, computer 30 includes in its memory a software program including program instructions that function as an imaging driver 38, e.g., printer/scanner driver software, for image forming device 100. Imaging driver 38 is in communication with controller 102. of image forming device 100 via communications link 40. Imaging driver 38 facilitates communication between image forming device 100 and computer 30. One aspect of imaging driver 38 may be, for example, to provide formatted print data to image forming device 100, and more particularly to print engine 110, to print an image. Another aspect of imaging driver 38 may be, for example, to facilitate the collection of scanned data from scanner system 150.

In some circumstances, it may be desirable to operate image forming device 100 in a standalone mode. In the standalone mode, image forming device 100 is capable of functioning without computer 30. Accordingly, all or a portion of imaging driver 38, or a similar driver, may be located in controller 102 of image forming device 100 so as to accommodate printing and/or scanning functionality when operating in the standalone mode.

Figure 2:
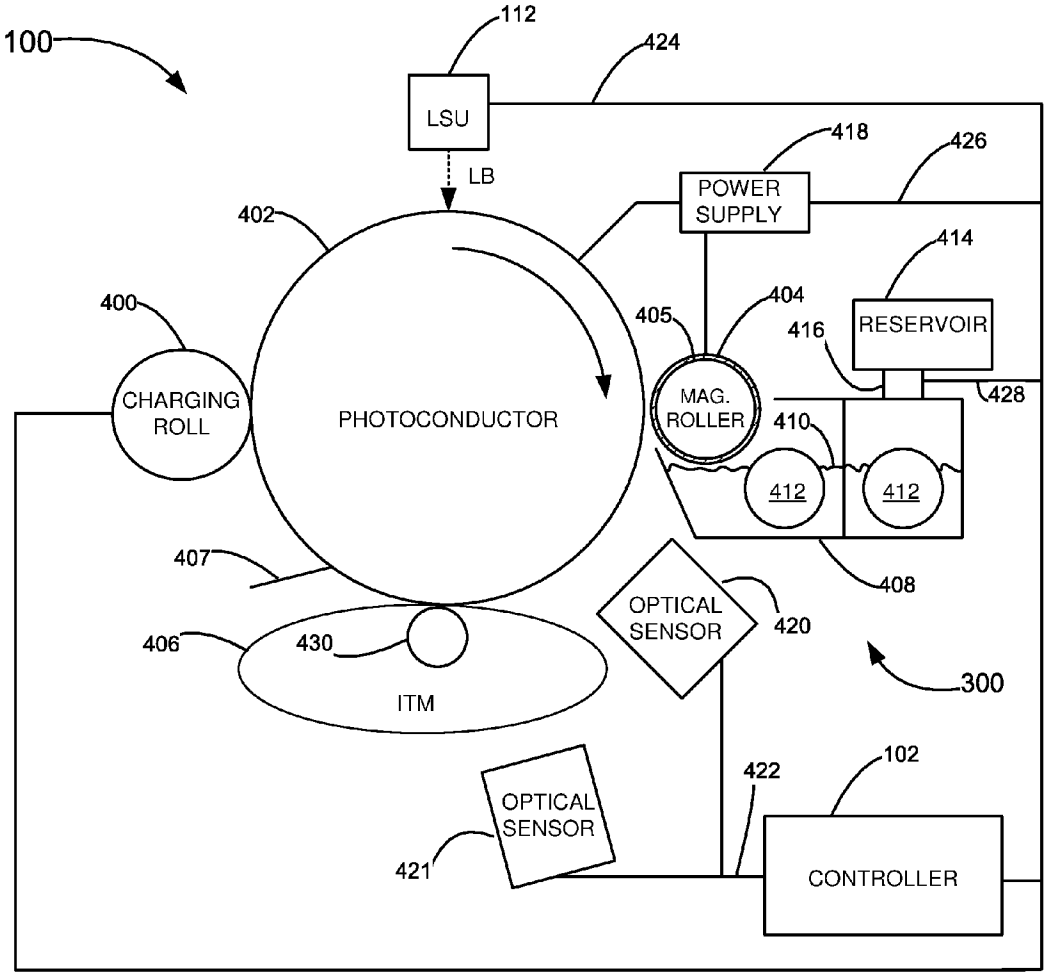
FIG. 2 is a schematic view of an imaging unit appearing on the image forming device of FIG. 1, according to an example embodiment.

FIG. 2 is a schematic view of imaging unit 300 appearing on image forming device 100 of FIG. 1. The electrophotographic printing process is well known in the art and, therefore, is briefly described herein. During a print operation, charging roll 400 charges the surface of photoconductor 402 to a specified voltage such as, for example, −1000 volts. A laser beam LB from LSU 112 is then directed to the surface of photoconductor 402 and selectively discharges those areas it contacts to form a latent image. In one embodiment, areas on photoconductor 402 illuminated by laser beam LB are discharged to approximately −300 volts. A magnetic roll 404 then transfers toner to the areas discharged on photoconductor 402 to form a toner image on photoconductor 402. The toner is attracted to the areas of the surface of photoconductor 402 discharged by the laser beam LB from LSU 112.

During toner development, magnetic roll 404 transfers toner by picking up carriers from a sump 408 via magnetic fields. In an example embodiment, magnetic roll 404 includes a rotatable endless sleeve 405 which is disposed around a stationary core of magnetic roll 404. The carrier may be, for example, magnetic carrier beads coated with a polymeric film or coating to provide triboelectric properties to attract toner to the carrier beads. Alternatively, the carrier may be, for example, magnetic carrier beads that lack a coating. Sump 408 is depicted herein as a dual component toner development system which contains a mixture 410 of carrier beads and toner particles. Augers 412 circulate the mixture 410 in a loop around the sump 408, which rubs the carrier beads and toner particles together. This causes the toner particles to obtain a charge due to the different triboelectrical values of the carrier and the toner. The charged toner particles cling to the carrier beads and, thus, are transported with the carrier beads by rotating sleeve 405 of magnetic roll 404 to a development region adjacent photoconductor 402, as explained in greater detail below with respect to FIG. 3. In an example embodiment, sump 408, augers 412, magnetic roll 404 and photoconductor 402 form imaging unit 300 of image forming device 100.

In an example embodiment in which image forming device 100 includes a multi-color printer, an intermediate transfer mechanism (ITM) 406 is disposed adjacent to photoconductor 402. A positive voltage field attracts the toner image from photoconductor 402 to the surface of the moving ITM 406. ITM 406 may include or otherwise be associatedwith a transfer roll 430 for each photoconductor 402, to facilitate the transfer of toner from ITM 406 to a sheet of media. ITM 406 rotates and collects the toner image from each photoconductor 402 in the multi-color printer and then conveys the toner images to a media sheet (not shown) for fusing in fuser 120 (shown in FIG. 1). A cleaning blade 407 removes any residual toner from the photoconductor 402. Note that, in some example embodiments that include a multi-color printer, ITM 406 may be absent and, thus, an image from each photoconductor 402 may be transferred directly to a media sheet.

Toner in sump 408 is replenished from a toner reservoir 414 via toner feed mechanism 416. Reservoir 414 may be, for example, a detachable bottle holding the main toner supply of image forming device 100. Toner feed mechanism may include, for example, a motor-driven auger. Note that a multi-color printer may contain separate imaging units 300, toner reservoirs 414 and toner feed mechanisms 416 for each toner color. For example, a four-color printer may contain four imaging units 300, toner reservoirs 414 and toner feed mechanisms 416.

A power supply 418 is controlled by controller 102 and is electrically connected to a conductive backplane of (or associated with) photoconductor 402 and is also connected to magnetic roll 404. Power supply 418 applies a voltage to the conductive backplane of photoconductor 402 and sleeve 405 of magnetic roll 404. In an example embodiment, the backplane of photoconductor 402 is at the ground potential. The voltage of sleeve 405 of magnetic roll 404, relative to the voltage of the backplane of photoconductor 402 is referred to as a development bias $V_B$ (shown in FIG. 3). Power supply 418 is also connected to charging roll 400 for providing a voltage thereto, for use in charging the outer surface of photoconductor 402, as discussed above. The voltage of the outer surface of photoconductor 402, relative to the voltage of the backplane of photoconductor 402, is also referred to as a development bias. In this way, controller 102 and power supply 418 control the application of development biases during a print operation to effectuate toner development onto the outer surface of photoconductor 402.

With continued reference to FIG. 2, image forming device 100 includes an optical sensor 420 which measures the reflectivity of the toner image to determine the density of toner developed on photoconductor 402. The toner images measured by the optical sensor may be, for example, rectangular toner patches with uniform image density within a toner patch. Optical sensor 420 is positioned to measure toner located on photoconductor 402. An alternate optical sensor 421 may be positioned to measure toner located on ITM 406. The alternate optical sensor 421 views ITM 406 instead of photoconductor 402 and thus measures toner images formed by any or all photoconductors 402.

Controller 102 communicates with optical sensor 420 and/or 421 via a communications link 422. Controller 102 also communicates with and controls the operation of LSU 112, power supply 418, and toner feed mechanism 416 via a communications link 424, a communications link 426, and a communications link 428, respectively.

Figure 3:
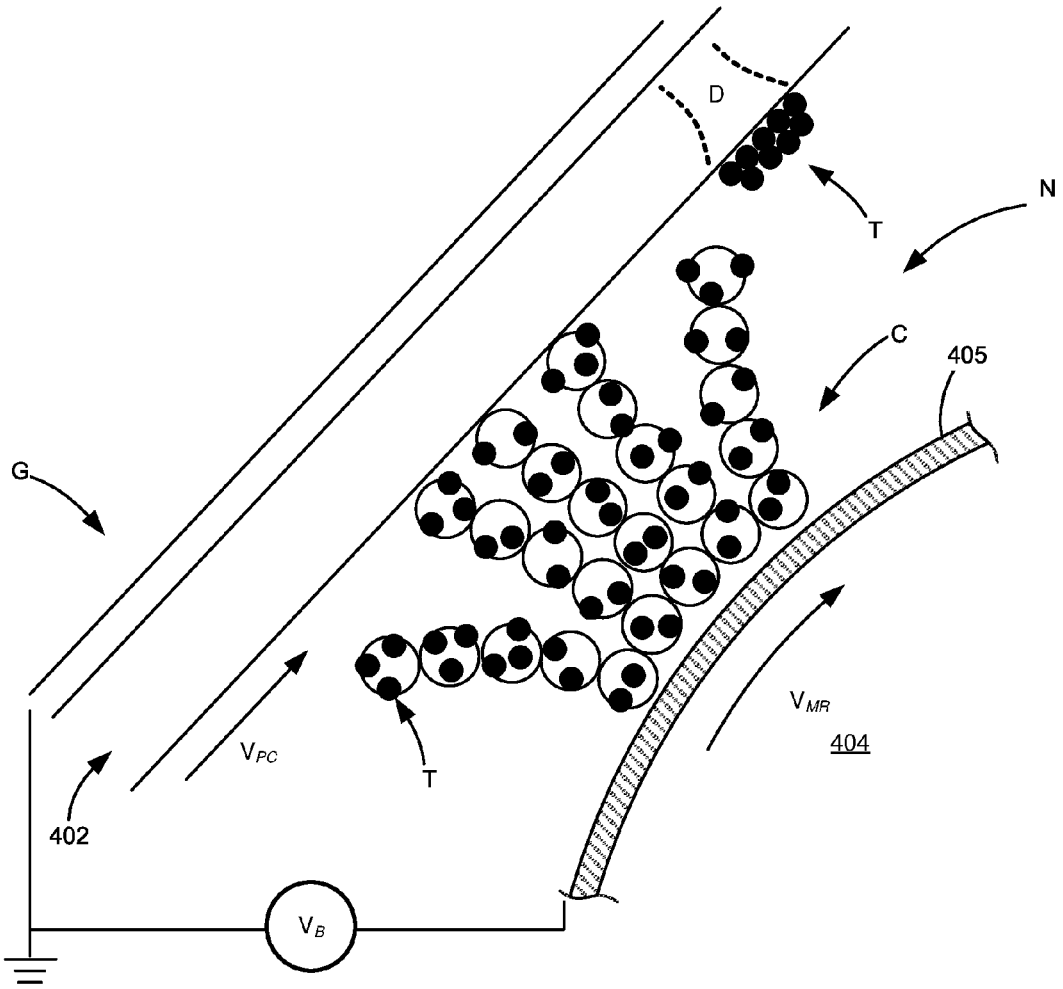
FIG. 3 is an enlarged view of a toner development region of the image forming device of FIGS. 1 and 2.

FIG. 3 is an enlarged view of toner development region N of image forming device 100, between photoconductor 402 and magnetic roll 404. Toner development region N includes carrier beads C having toner particles T adhered thereto. The direction in which photoconductor 402 moves during toner development is represented by $V_{PC}$. Sleeve 405 may be constructed from a non-magnetic material such as aluminum or the like. Sleeve 405 may be substantially entirely disposed about magnetic roll 404. A motor (not shown) may be coupled to rotate sleeve 405 about magnetic roll 404 as controlled by controller 140. According to an example embodiment, the motor may be mechanically coupled to sleeve 405 using coupling mechanisms known in the art, for rotating sleeve 405 during a print operation.

During toner development, sleeve 405 of magnetic roll 404 is rotated in a forward direction (represented by $V_{MR}$ in FIG. 3) so that carrier beads C having toner particles T adhered thereto cling to sleeve 405 due to magnetic forces acting on the carrier beads from magnetic roll 404. As sleeve 405 is rotated relative to magnetic roll 404 and the magnetic forces generated thereby, the magnetic carrier bead chains move in an alternating manner from substantially laying down and disposed against sleeve 405 to standing up and extending outwardly therefrom so as to form a magnetic brush in toner development region N.

Figure 4:
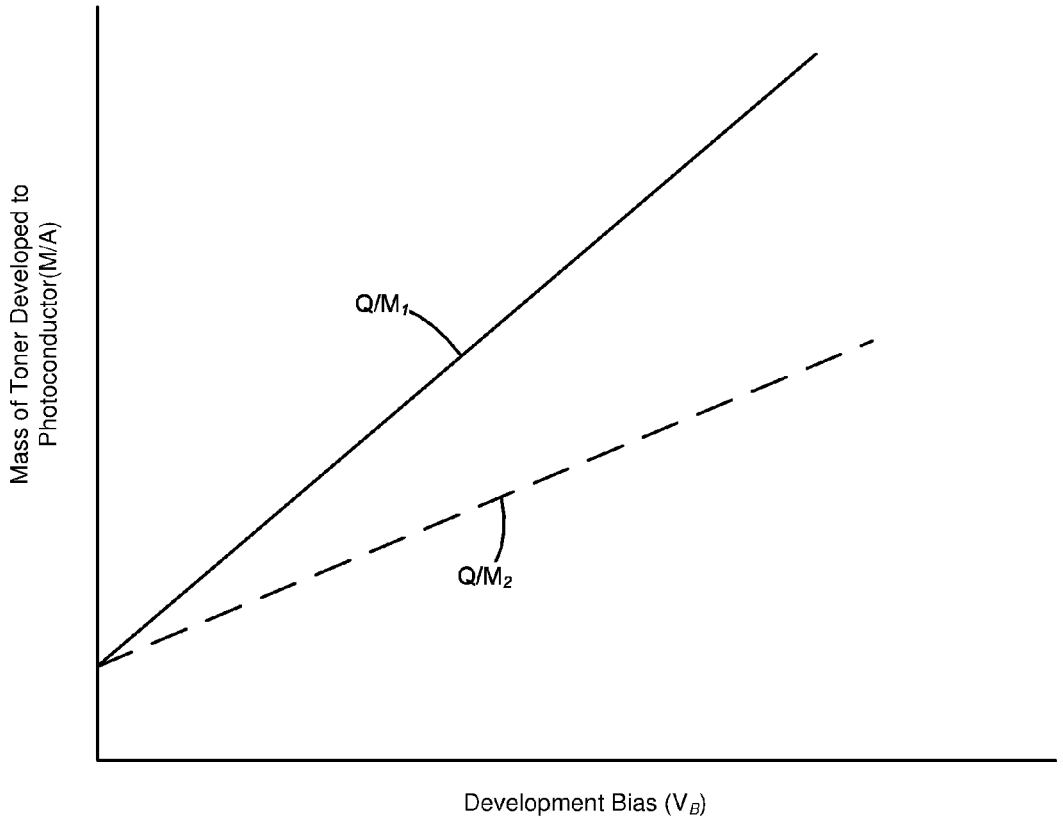
FIG. 4 is a graph relating the amount of toner developed to a photoconductor to the development bias showing different toner charges.

As illustrated in FIG. 3, when sleeve 405 is further rotated (still along direction $V_{MR}$) so that the carrier beads are in the toner development region N adjacent photoconductor 402, the carrier beads C again form chains extending outwardly from sleeve 405. As the carrier chains forming the magnetic brush make contact with photoconductor 402 in toner development region N, toner particles T detach from their respective carrier beads C due to the charge of the latent image on photoconductor 402 and move to the discharged areas of photoconductor 402 (represented by D in FIG. 3). Continued clockwise rotation of sleeve 405 results in the carrier beads C separating from sleeve 405 and fall into sump 408 due to a reduction in magnetic forces from magnetic roll 404 acting on the carrier beads C. The separated carrier beads C are then mixed with toner by augers 202 in sump 408 to begin again the toner development process. FIG. 4 shows a graph of the amount of toner developed to photoconductor 402 (represented as mass per unit area M/A along the y-axis) relative to the development bias $V_B$ applied between the ground plane of photoconductor 402 and the surface of magnetic roll 404 (along the x-axis). Note that, in FIG. 4, for a given toner charge (Q), the amount of toner developed to the surface of the photoconductor (M/A) increases generally linearly with the development bias $V_B$, as represented by lines $Q/M_1$ and $Q/M_2$. Line $Q/M_1$ which has a higher slope than line $Q/M_2$ depicts a higher toner charge. As a result, as toner charge increases because of imaging unit aging, more amount of toner is being developed to the surface of the photoconductor. Further, as photoconductor 402 ages, surface charge thereof also increases, increasing the likelihood of carrier beads C also being developed onto photoconductor 402 which reduces print quality.

Figure 5:
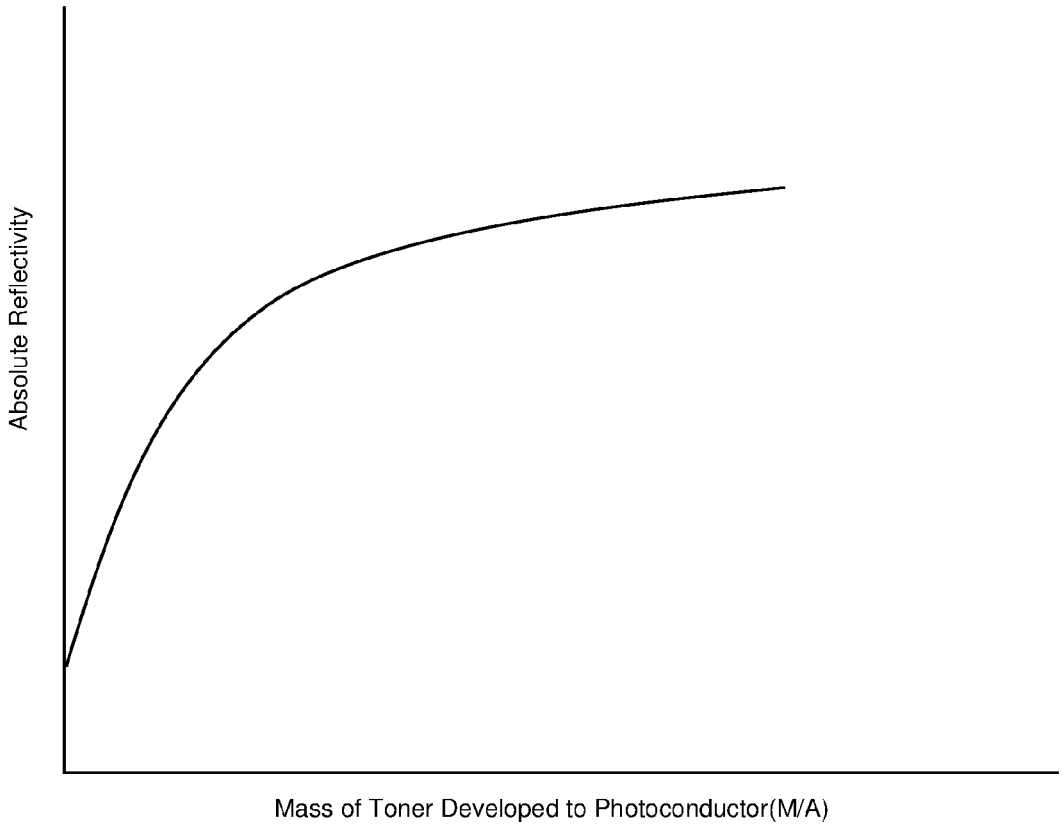
FIG. 5 is a graph relating absolute reflectivity of a toner patch to the amount of toner developed to a photoconductor.

FIG. 5 is a graph showing the relationship of the reflectivity of a toner patch (along the y-axis, in units of $Q/M^2$) to an amount of toner developed (in units of M/A along the x-axis) on photoconductor 402. The toner patch reflectivity is measured by optical sensor 420 and/or 421. In FIG. 5, the absolute reflectivity detected by optical sensor 420 and/or 421 increases generally in a non-linear fashion with the amount of toner developed to the photoconductor (M/A). With reference back to FIG. 4, the amount of toner developed to photoconductor 402 increases generally linearly with the development bias level. Based on FIGS. 4 and 5, it is noted that absolute reflectivity detected by optical sensor 420 and/or 421 increases generally with an increase in the development bias level, the development bias controls the absolute reflectivity, and the relationship between absolute reflectivity and development bias may he determined.

Example embodiments of the present disclosure described herein involve reducing or lowering development biases associated with magnetic roll 404 and photoconductor 402. In instances in which development biases are negative voltage levels relative to a ground reference, such reducing or lowering of development biases is understood to refer to reducing or lowering of the magnitude or absolute value of the development biases.

Figure 6A:
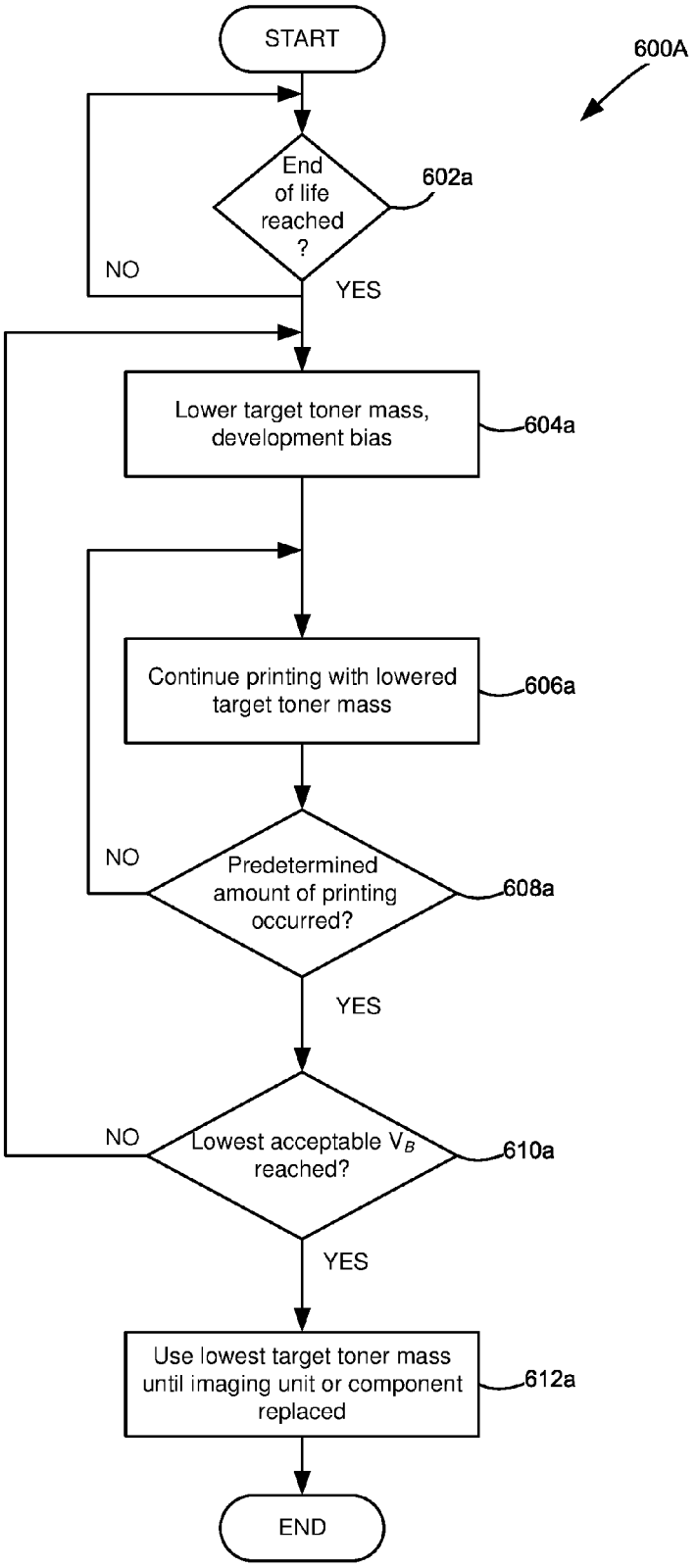
FIGS. 6A-6B are flowcharts showing different methods of controlling toner development in an image forming device when an end of life condition of the imaging unit has been reached, according to example embodiments.
Figure 6B:
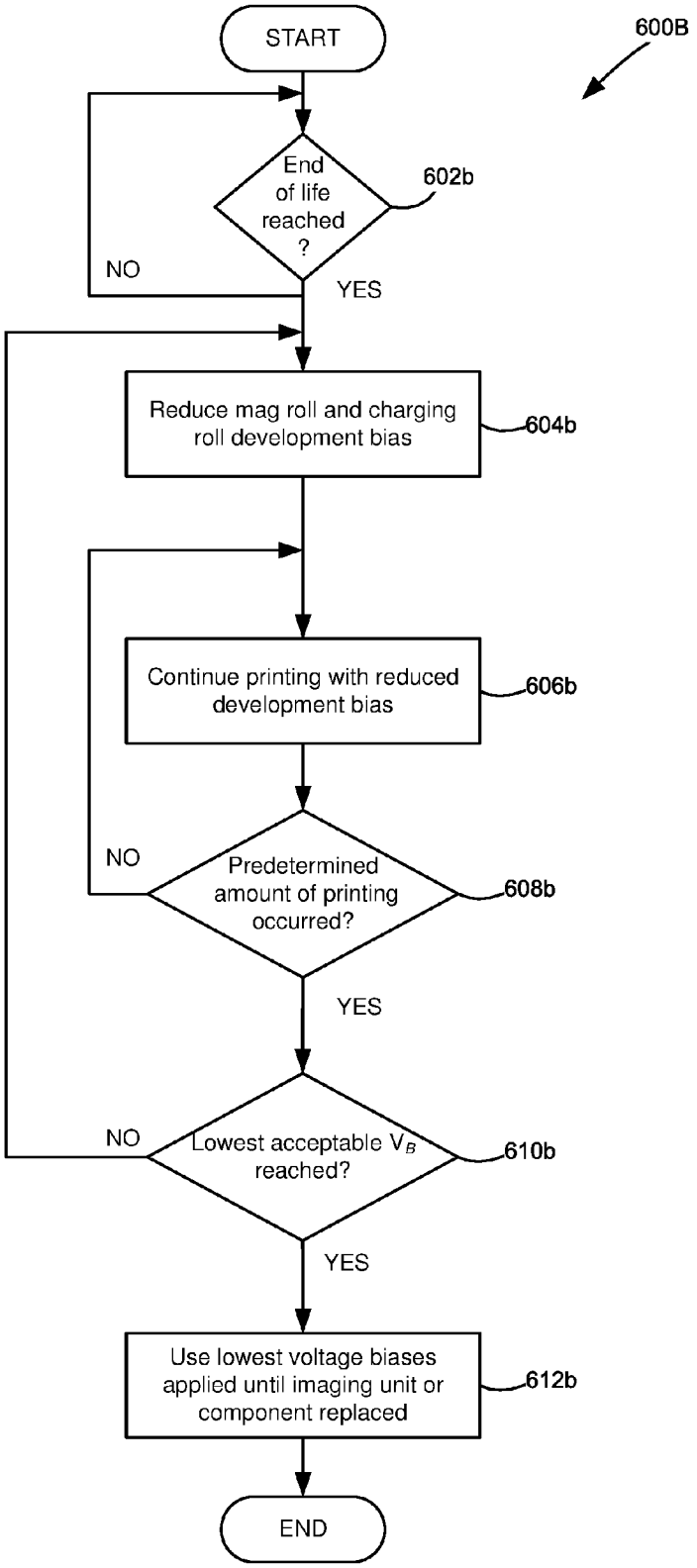

FIGS. 6A and 6B are directed to methods undertaken by image forming device 100 when controller 102 determines that imaging unit 300, or at least one of the components of imaging unit 300 (e.g., sump 408, augers 412, magnetic roll 404, photoconductor 402, etc.), has reached an end of life condition. Methods 600A and 600B are undertaken by image forming device 100 so as to reduce the occurrence of carrier bead development while at the same time allowing print operations to continue to be performed, though at reduced print quality levels, for a period of time until imaging unit 300 and/or the identified component(s) of imaging unit 300 is replaced.

In particular, FIG. 6A is directed to a method 600A of controlling toner development based on incrementally lowering the target toner mass amount to be sensed by optical sensor 420 and/or 421, which affects the development bias(es) in toner development region N during print operations. FIG. 6B is directed to an alternative method 600B of controlling toner development based on adjusting voltage biases to at least one of magnetic roll 404 and charging roll 400 so as to lower respective development biases in toner development region N (FIG. 3).

For purposes of the present disclosure, an "end of life" of imaging unit 300 refers to a point in time when carrier bead development becomes detrimental to the system with an increased risk that carrier beads will damage ITM 106, fuser 120, etc., despite imaging unit 300 being capable of continued use in additional print operations. In one aspect, an end of life of an imaging unit is determined by controller 102 to have been reached after a predetermined amount of print operations have been performed (i.e., a number of sheets of media having been printed or a number of revolutions of photoconductor 402 or magnetic roll 404 having occurred).

Reference is now made to method 600A of FIG. 6A. Acts of method 600A are based on use of toner patch measurements by optical sensors 420 and/or 421 to reduce the risk of carrier bead development so that printing, though with reduced print quality, may temporarily continue.

At block 602*a*, controller 102 determines whether an end of life of imaging unit 300 has been reached. For example, controller 102 may determine whether imaging unit 300 is at its end of life based on a predetermined number of revolutions of photoconductor 402 or magnetic roll 404 having occurred. In yet another embodiment, a determination that one or more components of imaging unit 300 has reached its end of life may cause controller 102 to determine that imaging unit 300 has reached its end of life. Other scenarios where controller 102 of image forming device 100 may be able to detect an end of life of imaging unit 300 are contemplated.

Upon a determination by controller 102 at block 602*a* that imaging unit 300 has reached its end of life, at block 604*a* controller 102 lowers a target toner mass amount for toner patches to be measured by optical sensor 420 and/or 421. The amount by which the target toner mass is lowered is predetermined and may be, for example, a predetermined fraction of the initial target toner mass used or a predetermined fraction of the most recently used target toner mass. With the target amount of toner lowered, controller 102 calculates the corresponding amount of reflectivity expected to be measured by optical sensor 410 and/or 421 through use of FIG. 5, and the corresponding development bias $V_B$ needed to achieve the targeted toner mass amount, using the graph of FIG. 4.

At block 606*a*, image forming device 100 continues performing print operations with the lowered target toner mass and corresponding lowered development bias $V_B$ from block 604*a*. In continuing to perform print operations at the lowered target toner mass and corresponding lowered development bias, the risk of damage to imaging unit 300 or to other components of the device is reduced due to the lowering of development bias $V_B$. This is because the amount of toner extracted from carrier beads C is reduced such that the charge of the beads C with toner particles extracted is lessened, which lessens the chances of carrier beads C developing on photoconductor 402. It is noted that though printing with imaging unit 300 is extended with reduced risk of damage, performing print operations with lowered development bias $V_B$ results in a reduction in print quality.

At block 608*a*, controller 102 determines whether a predetermined amount of printing has occurred since controller 102 lowered the target toner mass in block 604*a*. In one example embodiment, performing such determination may include determining whether photoconductor 402 or magnetic roller 404 has completed a predetermined number of revolutions or printed a predetermined number of sheets of media since such target toner mass lowering.

If controller 102 determines that a predetermined amount of printing has not occurred in block 608*a*, printing continues to be performed at the lowered target toner mass and lowered development bias from block 604*a*. Otherwise, if controller 102 determines at block 608*a* that the predetermined amount of printing has occurred, controller 102 determines whether a lowest acceptable development bias level has been reached (block 610*a*). Herein, the "lowest acceptable development bias level" refers to a lowest possible development bias at which image forming device 100 and/or imaging unit 300 can operate with a substantially reduced risk of damage due to carrier head development while still meeting an acceptable level of print quality. In an example embodiment, the lowest acceptable development bias level is a predetermined bias level.

If controller 102 determines at block 610*a* that the lowest acceptable development bias level has not been reached, controller 102 further lowers the target toner mass. In particular, upon a negative determination at block 610*a*, controller 102 repeats blocks 604*a* to 610*a*. Blocks 604*a*-610*a* are repeated one or more times until controller 102. determines that the most recently lowered target toner mass amount resulted in the development bias reaching the lowest acceptable development bias level, at which point controller 102 continues using the most recently lowered target toner mass until imaging unit 300 is replaced (block 612*a*).

As a result of incrementally lowering the target toner mass for measurement by optical sensor 420 and/or 421 upon determining that an end of life of imaging unit 300 has been reached, the development bias $V_B$ is reduced such that the risk of damage to image forming device 100 due to carrier bead development on photoconductor 402 is reduced. Though print quality is lessened due to the reduction in the development bias $V_B$, image forming device 100 is nevertheless able to continue printing with the reduced risk of damage thereto.

it is understood that in an example embodiment, the development bias associated with the surface of photoconductor 402 (created by charging roll 400) may also be reduced each time block 604*a* is executed, resulting in both development biases associated with development region N being incrementally reduced.

Reference is now made to method 600B on FIG. 6B. Steps of method 600B are based on incrementally reducing and/or subtracting a specific bias amount from the development biases associated with development region N, i.e., the biases of charging roll 400 (which charges the surface of photoconductor 402) and magnetic roll 404, relative to the backplane of photoconductor 402, so as to reduce the occurrence of carrier bead development onto photoconductor 402 and thereby reduce the risk of damaging image forming device 100 when imaging unit 300 has reached its end of life.

At block 602*b*, controller 102 determines whether an end of life of imaging unit 300 or a component thereof has been reached. Controller 102 performs the same act in block 602*b* as described above in block 602*a* of method 600A.

Upon determining that an end of life of imaging unit 300 has been reached, at block 604*b*, controller 102 reduces the development bias for magnetic roll 404 and charging roll 400. For example, if selected development biases are −400V to be applied to magnetic roll 404 and −450V to charging roll 400, then once an end of life of imaging unit 300 has been detected in block 602*b*, the voltage biases applied to magnetic roll 404 and charging roll 400 are reduced to −300V to −350V, respectively. In an example embodiment, reduction of voltage biases applied to magnetic roll 404 and charging roil 400 is based on current development bias levels. In another example embodiment, the amount of voltage bias reduction for magnetic roll 404 and charging roll 400 may be a predetermined amount unrelated to current development biases.

At block 606*b*, image forming device 100 continues performing print operations with the reduced development biases from block 604*b* with reduced print quality due to the development bias reductions. In continuing to perform print operations using the reduced development biases, less carrier beads C will develop onto photoconductor 402 such that the risk of damage to the imaging unit or to other components of image forming device 100 is reduced.

Similar to block 608*a*, at block 608*b*, controller 102 determines whether a predetermined amount of printing has occurred since the last time the development bias levels have been reduced. As with block 608*a*, in one example embodiment, performing such determination at block 608*b* may include determining whether photoconductor 402 or magnetic roller 404 has completed a predetermined number of revolutions, or whether image forming device 100 printed a predetermined number of sheets of media since the latest development bias reductions.

If it controller 102 determines that a predetermined amount of printing has not occurred, printing continues to be performed without any change to the development biases. Otherwise, if controller 102 determines at block 608*b* that the predetermined amount of printing has occurred, controller 102 determines whether the lowest acceptable development bias levels have been reached (block 610*b*). Determining whether lowest acceptable development bias levels have been reached may include determining whether each of the voltage biases applied to magnetic roll 404 and charging roll 400 has reached apredetermined threshold voltage bias. Similar to block 610*a*, the lowest development bias levels refer to the lowest possible development biases at which image forming device 100 and/or imaging unit 300 can operate with a substantially reduced risk of damage due to carrier bead development while still meeting an acceptable level of print quality.

If controller 102 determines at block 610*b* that the lowest acceptable development bias levels have not been reached, controller 102 further reduces the development biases by reducing the voltage bias for each of magnetic roll 404 and charging roll 400. In particular, upon a negative determination at block 610*b*, controller 102 repeats blocks 604*b* to 610*b*. Blocks 604*b*-610*b* may be repeated one or more times until controller 102 determines that the most recently reduced voltage biases of magnetic roll 404 and charging roll 400 resulted in the development biases reaching the lowest acceptable development bias levels, at which point, controller 102 continues using the most recently reduced voltage biases until imaging unit 300 is replaced (block 612*b*).

It is understood that in an example embodiment, the development biases of magnetic roll 404 and charging roll 400 may be reduced by different amounts and at different times.

As a result of reducing the magnitude of voltage biases of magnetic roll 404 and charging roll 400 at a first instance or subsequent instances upon determining that an end of life of imaging unit 300 has been reached, any risk of damage to image forming device 100 due to carrier bead development on photoconductor 402 is reduced.

The foregoing description illustrates various aspects and examples of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

What is claimed is:

1. An image forming apparatus, comprising:

a photoconductive member;

a first roll disposed adjacent to the photoconductive member between which toner development occurs, the photoconductive member and the first roll forming at least part of an imaging unit of the image forming apparatus;

a second roll disposed adjacent to the photoconductive member for charging thereof;

a sensing mechanism including an optical sensor which measures toner density at a predetermined location in the image forming apparatus; and a controller communicatively coupled to the sensing mechanism and controlling a voltage bias applied to the first roll, wherein the controller is configured to determine whether an end of life of the imaging unit has been reached, and wherein upon a positive determination by the controller that the end of the life of the imaging unit has been reached, the controller reduces toner density during toner development by reducing the voltage bias applied to the first roll and by reducing a voltage bias applied to the second roll along with the reducing the voltage bias applied to the first roll.

2. The image forming apparatus of claim 1, wherein following the voltage bias of the first roll being reduced, the controller further reduces the voltage bias applied to the first roll during toner development in each instance a predetermined amount of printing occurs since a last instance of the voltage bias being reduced, until a predetermined development bias level is reached or the imaging unit or said at least part of said imaging unit is replaced.

3. The image forming apparatus of claim 2, wherein when the predetermined development bias level is reached, a latest voltage bias applied to the first roll during toner development is maintained for subsequent printing operations.

4. An image forming apparatus, comprising:

a photoconductive member;

a housing containing toner and carrier beads;

a magnetic roll at least partly disposed within the housing and generating at least one magnetic field, the magnetic roll having a magnetic core and an endless sleeve disposed around the magnetic core for forming a toner development region with the photoconductive member when the housing is operably associated with the photoconductive member;

a sensing mechanism which measures toner density at a predetermined location in the image forming apparatus; and a controller communicatively coupled to the sensing mechanism and controlling a voltage bias applied to the endless sleeve of the magnetic roll and to the photoconductive member, wherein the controller determines whether at least one of the photoconductive member, the toner and the carrier beads in the housing has reached an end of life condition, and wherein upon a positive determination, the controller lowers a development bias associated with the photoconductive member and with the endless sleeve of the magnetic roll, and further lowers the development bias each time following a predetermined amount of printing occurring since an immediately prior instance of lowering the development bias, and wherein the controller lowers the development bias in response to the controller lowering a target toner mass to be sensed by the sensing mechanism at the predetermined location in the image forming apparatus.

5. The image forming apparatus of claim 4, wherein the controller lowers the development bias associated with the photoconductive member and the magnetic roll until a predetermined lowest development bias has been reached or the at least one of the photoconductive member, the toner and the carrier beads has been replaced.

6. The image forming apparatus of claim 5, wherein when the predetermined lowest development bias has been reached, the controller maintains the predetermined lowest development bias for use in subsequent printing operations until the at least one of the photoconductive member, the toner and the carrier beads is replaced.

7. The image forming apparatus of claim 4, further comprising a charging roll disposed adjacent to the photoconductive member for charging the photoconductive member, the controller applying a second voltage bias to the charging roll, and wherein upon the positive determination that the at least one of the photoconductive member, the toner and the carrier beads has reached an end of life condition, the controller adjusts the voltage bias applied to the endless sleeve of the magnetic roll and the second voltage bias applied to the charging roll during toner development such that the development bias is lowered.

8. An image forming apparatus, comprising:

a photoconductive member;

a first roll disposed adjacent to the photoconductive member between which toner development occurs, the photoconductive member and the first roll forming at least part of an imaging unit of the image forming apparatus;

a sensing mechanism including an optical sensor which measures toner density at a predetermined location in the image forming apparatus; and a controller communicatively coupled to the sensing mechanism and controlling a voltage bias applied to the first roll, wherein the controller is configured to determine whether an end of life of the imaging unit has been reached, and wherein upon a positive determination by the controller that the end of the life of the imaging unit has been reached, the controller reduces toner density during toner development by reducing the voltage bias applied to the first roll and prior to reducing the voltage bias applied to the first roll, the controller lowers a target toner density to be measured by the sensing mechanism at the predetermined location in the image forming apparatus during the toner development.

* * * * *